US006230940B1

(12) United States Patent
Manning et al.

(10) Patent No.: US 6,230,940 B1
(45) Date of Patent: May 15, 2001

(54) ONE-PIECE DISPENSING SYSTEM AND METHOD FOR MAKING SAME

(75) Inventors: James P. Manning, Chagrin Falls, OH (US); John M. Hess, III, Midland; Timothy R. Socier, Essexville, both of MI (US)

(73) Assignee: Seaquist Closures Foreign, Inc., Crystal Lake, IL (US)

( * ) Notice: Subject to any disclaimer, the term of this patent is extended or adjusted under 35 U.S.C. 154(b) by 0 days.

(21) Appl. No.: 09/432,677

(22) Filed: Nov. 2, 1999

(51) Int. Cl.[7] ..... B67D 5/06

(52) U.S. Cl. ..... 222/185.1; 222/212; 222/490; 222/494; 220/89.1; 220/203; 220/205

(58) Field of Search ..... 222/181.2, 185.1, 222/206, 212, 215, 490–496; 220/89.1, 203, 205

(56) References Cited

U.S. PATENT DOCUMENTS

| | | | |
|---|---|---|---|
| 1,206,661 | 11/1916 | Booth . | |
| 1,825,553 | 9/1931 | Smith . | |
| 1,951,544 | 3/1934 | Burrell | 221/60 |
| 1,989,714 | 2/1935 | Staham | 221/60 |
| 2,175,052 | 10/1939 | Bull et al. | 221/60 |

(List continued on next page.)

FOREIGN PATENT DOCUMENTS

| | | |
|---|---|---|
| 26719/88 | 9/1988 | (AU) . |
| 477 332 | 10/1969 | (CH) . |
| 23 54 093 | 5/1970 | (DE) . |
| 21 28 875 | 12/1972 | (DE) . |
| 26 09 310 | 9/1976 | (DE) . |
| 834 524 | 3/1992 | (DE) . |
| 295 13 995 U1 | 1/1996 | (DE) . |
| 0 160 336 | 11/1985 | (EP) . |
| 226290 | 6/1987 | (EP) . |
| 278125 | 8/1988 | (EP) . |
| 395380 | 10/1990 | (EP) . |
| 996998 | 12/1951 | (FR) . |
| 1135210 | 4/1957 | (FR) . |
| 1046518 | 10/1966 | (GB) . |
| 2098958 | 12/1981 | (GB) . |
| 58-73738 | 5/1983 | (JP) . |
| 145824 | 6/1962 | (SU) . |
| WO 99/12821 | 3/1999 | (WO) . |

*Primary Examiner*—Joseph A. Kaufman
(74) *Attorney, Agent, or Firm*—Rockey, Milnamow & Katch, Ltd.

(57) ABSTRACT

A dispensing system is provided for being sealingly disposed with respect to, and dispensing a product from, a discharge opening of a container wherein an annular mounting flange extends radially inwardly adjacent the opening. The valve is molded from a material to define a flexible, resilient structure having a head portion and a surrounding marginal portion. The head portion has a normally closed dispensing orifice which opens when the pressure in the interior of the container exceeds the pressure on the exterior of the valve by a predetermined amount. The marginal portion is connected with the head portion and has a generally annular wall defining a generally annular groove which is open radially outwardly for receiving the mounting flange. The annular wall is sufficiently flexible to elastically deform as the wall is forced against the mounting flange to accommodate sealing of the mounting flange in the groove. The annular wall is sufficiently resilient to accommodate the retention of the mounting flange in the groove by adjacent portions of the annular wall.

11 Claims, 2 Drawing Sheets

U.S. PATENT DOCUMENTS

| | | | |
|---|---|---|---|
| 2,758,755 | 8/1956 | Schafler | 222/213 |
| 3,063,601 | 11/1962 | Hertz | 222/213 |
| 3,342,379 | 9/1967 | Foley | 222/173 |
| 3,490,488 | 1/1970 | Grist | 137/512.4 |
| 4,166,553 | 9/1979 | Fraterigo | 222/181 |
| 4,408,702 | 10/1983 | Horvath | 222/212 |
| 4,434,810 | 3/1984 | Atkinson | 137/493 |
| 4,470,523 | 9/1984 | Spector | 222/181 |
| 4,728,006 | 3/1988 | Drobish et al. | 222/181 |
| 4,749,108 | 6/1988 | Dornsbusch et al. | 222/212 |
| 4,794,750 | 1/1989 | Schmidt et al. | 53/410 |
| 4,987,740 | 1/1991 | Coleman | 60/588 |
| 4,991,745 | 2/1991 | Brown | 222/212 |
| 5,033,655 | 7/1991 | Brown | 222/212 |
| 5,071,017 | 12/1991 | Stull | 215/260 |
| 5,115,950 | 5/1992 | Rohr | 222/490 |
| 5,213,236 | 5/1993 | Brown et al. | 222/185 |
| 5,307,955 | 5/1994 | Viegas | 222/107 |
| 5,339,995 | 8/1994 | Brown et al. | 222/185 |
| 5,377,877 | 1/1995 | Brown et al. | 222/105 |
| 5,409,144 | 4/1995 | Brown | 222/185 |
| 5,439,143 | 8/1995 | Brown et al. | 222/185 |
| 5,472,123 | 12/1995 | Jangaard | 222/212 |
| 5,839,614 | 11/1998 | Brown | 222/185 |
| 6,089,419 * | 7/2000 | Gross | 222/494 |

* cited by examiner

ONE-PIECE DISPENSING SYSTEM AND METHOD FOR MAKING SAME

TECHNICAL FIELD

This invention relates to a system for dispensing a product from a container. The invention is more particularly related to a system incorporating a dispensing valve which is especially suitable for use with a squeeze-type container wherein a product can be discharged from the container through the valve when the container is squeezed.

BACKGROUND OF THE INVENTION AND TECHNICAL PROBLEMS POSED BY THE PRIOR ART

A variety of packages, including dispensing packages or containers, have been developed for personal care products such as shampoo, lotions, etc., as well as for other materials. Such containers typically have a neck defining an open upper end on which is mounted a dispensing closure. One type of dispensing closure for these kinds of containers typically has a flexible, pressure-openable, self-sealing, slit-type dispensing valve mounted in the closure over the container opening. When the container is squeezed, the valve slits open, and the fluid contents of the container are discharged through the open slits of the valve. The valve automatically closes to shut off fluid flow therethrough upon removal of the increased pressure.

Designs of closures using such valves are illustrated in the U.S. Pat. Nos. 5,409,144, 5,676,289, and 5,033,655. Typically, the closure includes a body mounted on the container neck to hold the valve over the container opening.

A lid can be provided for covering the valve during shipping and when the container is otherwise not in use. See, for example, FIGS. 31–34 of U.S. Pat. No. 5,271,531. Such a lid can be designed to prevent leakage from the valve under certain conditions. The lid can also keep the valve clean and/or protect the valve from damage.

A dispensing closure incorporating such a pressure-openable valve provides advantages not found in other types of dispensing closures. For example, another common type of dispensing closure has a base defining a dispensing orifice which is normally occluded by a closed lid having a plug which enters into, and seals, the orifice. The lid must be lifted open to permit the product to be dispensed through the closure orifice. The lid must be manually closed after dispensing the product in order to permit the container to be carried or moved in any position other than a non-vertical position. Further, the lid must be closed in order to minimize evaporation or drying out of the product within the container. Also, the lid must be closed in order to prevent contaminant ingress.

Other types of dispensing closures include lift-up spouts or rotatable valve members. These features must be manipulated by the user when it is desired to open a dispensing passage and must be manipulated by the user when it is desired to close the dispensing passage.

With the above-discussed conventional types of dispensing closures that do not incorporate a pressure-openable valve, it may be possible to store the container with the closure thereon in an inverted position (with the dispensing closure at the bottom) so as to maintain the container product near the dispensing passage or orifice. This may be advantageous when the product is a rather viscous liquid because, when the inverted dispensing closure is opened, the product is already located at the dispensing passage or orifice and the dispensing time is minimized.

However, while the inverted storage of such a dispensing closure and container may speed dispensing of a viscous product, this can result in creating a rather messy condition at or around the dispensing closure passage or orifice. For example, with conventional dispensing closures that have a lid plug sealingly occluding a dispensing orifice in a closure base, inverted storage causes the inner end of the lid plug to be coated with the product. When the lid is opened, the product on the end of the plug is carried with the plug along the surface of the orifice. Some of the product sticks to the surface of the orifice and/or adjacent exterior edges of the closure base around the orifice. Some of the product also sticks to the lid plug. When the lid is subsequently closed after dispensing the product, the product on the lid plug and around the closure base orifice can create a messy condition around the exterior edge of the dispensing orifice. With the dispensing closure in the closed condition, the product around the exterior of the dispensing orifice can dry out and become somewhat hardened or encrusted during a subsequent period of non-use. This is not only aesthetically unpleasant, but it can inhibit the easy opening of the lid during subsequent use.

A pressure-openable dispensing valve advantageously eliminates or minimizes some of the above-discussed problems. Because such a valve does not have to be directly manipulated to effect its opening or closing, the user merely needs to squeeze the container to effect dispensing of the container product. Although such a simple squeezing action is generally required for dispensing a product, especially a viscous product, through any type of dispensing closure, the use of a pressure-openable valve in a dispensing closure eliminates the need to also initially, manually manipulate the valve, spout, or lid employed with other types of conventional closures.

Because a closure with a pressure-openable dispensing valve remains closed unless the container is squeezed, the closure and container can be inverted for storage (with the dispensing closure and valve at the bottom). Product does not leak through such a valve, and there is little or no mess on the exterior of the valve or surrounding closure surfaces.

Further, the use of a pressure-openable valve permits more accurate control of the dispensing process. Because the pressure-openable valve typically has a relatively thin membrane in which the dispensing slots are defined, there is no long orifice or passage through which the product must pass prior to discharge from the dispensing closure. Thus, the product discharges from the dispensing closure through such a pressure-openable valve relatively quickly and in substantially direct response to squeezing forces applied to the container which are readily sensed by the user as the user squeezes the container. The user has a more accurate "feel" of the relationship between the container squeezing force and the discharging product as the user squeezes the container.

Further, because the pressure-openable valve membrane defining the dispensing aperture slits is relatively thin, and because the valve can be positioned in the dispensing closure at, or very near, the most exterior surface of the closure, the user can readily observe the valve and its dispensing slits. Thus, the user can easily see the product being discharged, and the user can more readily determine how hard to squeeze the container and when to terminate the squeezing of the container.

While dispensing closures with pressure-openable dispensing valves function generally satisfactorily in applications for which they are designed, it would be desirable to provide an improved dispensing system incorporating such pressure-openable valves. For example, in conventional dispensing closures incorporating such pressure-openable valves, special retention systems are required to hold the valves within the closures. In particular, a pressure-openable valve typically is retained in the closure base by means of a separate retainer ring which is snap-fit into the closure base over a flange of the valve. Thus, at least three separate components are typically required in such a conventional dispensing closure: the closure base (which may or may not include an auxiliary, hinged lid), the pressure-openable valve, and the retainer ring.

Such snap-fit rings are small and somewhat flexible. Because the pressure-openable valve and the retainer ring are both relatively small, it is difficult to provide a design which facilitates component assembly and proper snap-fit retention. Careful control of dimensional tolerances is required in order to insure that the components can be properly assembled and in order to insure proper engagement of the snap-fit retention features.

During the manufacture of such a dispensing closure, processes must be employed to manufacture, handle, and assemble (1) the relatively small, and very flexible, pressure-openable valve, (2) the small, snap-fit retainer ring, and (3) the closure base. The manufacturing processes include the following: the manufacture of the three components, the temporary storage of the three components, the processing of the three components (including quality control inspections and material handling (including conveying)), and the assembly of the components.

The above-discussed manufacturing processes are susceptible to problems. For example, the components can be inadvertently damaged during the manufacturing operations. The components can also be inadvertently misaligned during assembly (e.g., resulting in an ineffective, or loose, snap-fit retention of the valve within the closure base). This can more easily occur if the valve is molded from liquid silicone rubber which is soft and pliable. Such a material is preferred in some types of packaging, and has proven particularly advantageous since the material is inherently relatively inert, and will therefore not either adulterate or react with most products contained within a container. Examples of a commercially available valve molded from silicone rubber are disclosed in the above-identified U.S. Pat. Nos. 5,409,144, 5,439,143, and 5,676,289, and these patents are incorporated herein by reference thereto.

Although liquid silicone rubber possesses many attributes for use in packaging, it also has other characteristics which render such applications problematic. For example, the surfaces of silicone rubber components are extremely tacky or sticky, having a very high coefficient of friction. As a result, the proper handling of such components is difficult. For example, in attempting to attach a silicone rubber dispensing valve to a container by a conventional snap-fit retainer ring or threaded collar arrangement, the surfaces of the valve flange may stick to the adjacent surfaces of the container and a retainer ring or threaded collar before the ring or collar can be mounted securely enough to create a leak-resistant seal. Tightening of the threaded collar often causes the valve flange, as well as the entire valve, to distort from its designed shape, thereby preventing the formation of a secure seal, and/or changing the intended dispensing and sealing characteristics of the valve.

Thus, the manufacturing processes—involving separate molding of three or more components, inspection, handling, and assembly—must be undertaken with great care which is difficult and expensive to provide. Notwithstanding the exercise of a high degree of care in the manufacturing processes, such processes remain a potential source of trouble and can occasionally result in the manufacture of a defective assembly.

Further, the multi-component dispensing closure employing a pressure-openable valve is prone to failure after manufacture when subjected to intentionally or inadvertently applied high impact loads. For example, when a completed multi-component closure is shipped to a packager for mounting on a filled container, the packager typically handles the closure with automatic equipment. A portion of the closure may be snagged by such equipment, or the closure may be pushed with excessive force against another object. These actions may lead to a loosening or separation of the closure assembly components prior to, or during, the mounting of the closure on the filled container. This can create problems in the packager's automated filling line and lead to spills and/or shutdowns of the line while the problem is corrected.

In addition, when the completed package (comprising the filled container and multi-component dispensing closure mounted thereon) is put into the distribution channels by the packager, accidental or intentional loads imposed on the closure may cause a failure of a part of the closure. If the package is subjected to excessive impact forces during shipping and/or while being stored and/or displayed, then damage (e.g., loosening) of the closure components may occur.

Also, the fact that the conventional closure includes an assembly of the three components (closure body, valve, and retention ring or collar) makes it easier for someone to tamper with the closure by partially or completely separating the closure components. Accordingly, it would be desirable to provide an improved dispensing system which would eliminate, or at least minimize, the problems associated with multi-component dispensing closures.

It would also be desirable to provide an improved dispensing system for a package which would reduce the number of separate components needed to produce a completed package.

It would also be beneficial if such an improved dispensing system could accommodate the use of a variety of different materials.

Further, it would be desirable if such an improved dispensing system could be provided with a design that would accommodate efficient, high quality, large volume manufacturing techniques with a reduced product reject rate.

The present invention provides an improved dispensing system which can accommodate designs having the above-discussed benefits and features.

SUMMARY OF THE INVENTION

According to one aspect of the present invention, a dispensing system is provided for a container. The dispensing system is adapted to be sealingly disposed with respect to, and dispense a product from, a discharge opening of a dispensing end structure of a container wherein an annular mounting flange extends radially inwardly adjacent the opening. The product may be a liquid or other generally flowable substance, such as a granular or particulate material or a powder.

The dispensing system includes a dispensing valve molded from at least one material to define a flexible, resilient structure having a central head portion, a sleeve extending outwardly from the flexible, central head portion, and a surrounding marginal portion. The head portion has intersecting slits that define a normally closed dispensing orifice which opens when the pressure in the interior of the container exceeds the pressure on the exterior of the valve by a predetermined amount. The marginal portion of the valve is connected with the head portion, and the marginal portion has a generally annular wall defining a generally tubular groove which is open radially outwardly for receiving the mounting flange.

The mounting flange may be part of the container. Alternatively, the mounting flange may be part of a separate closure which is adapted to be permanently or releasably attached to the container. The generally annular wall of the valve which defines the annular groove is sufficiently flexible to temporarily deform as the wall is forced against the mounting flange to accommodate seating of the mounting flange in the groove. The annular wall is also sufficiently resilient to accommodate the retention of the mounting flange in the groove by adjacent portions of the wall.

The groove is defined at a location along the vertical height of the annular wall to locate the sleeve and head portion within the discharge opening when the valve head portion is closed while the valve is sealingly disposed with respect to the discharge opening.

In a preferred embodiment, the valve is molded from a liquid silicone rubber, and the valve has a dispensing orifice defined by normally closed slits. Preferably, the valve annular wall includes a generally annular upper shoulder and a generally annular, lower retention flange. The groove is located between the shoulder and the retention flange. Preferably, the lower retention flange has a height which exceeds the height of the groove.

Preferably, the upper shoulder defines a generally frustoconical lead-in surface facing generally away from the retention flange and defines a generally undercut surface which faces generally toward the retention flange so as to define one side of the groove. The retention flange preferably has a generally flat, annular, upper surface facing toward the undercut surface so as to define one side of the groove. Preferably, the retention flange extends radially outwardly beyond the radial extent of the upper shoulder.

According to one aspect of the present invention, the dispensing system includes only one component—the valve adapted to be mounted to the structure that defines the mounting flange. These are easy to assemble and remain securely attached once assembled. The dispensing system of the present invention minimizes problems associated with using dispensing closure assemblies which include three or more components which must be assembled together. The dispensing system of the present invention can accommodate efficient, high-quality manufacturing techniques with a reduced product reject rate.

Numerous other advantages and features of the present invention will become readily apparent from the following detailed description of the invention, from the claims, and from the accompanying drawings.

BRIEF DESCRIPTION OF THE DRAWINGS

In the accompanying drawings forming part of the specification, in which like numerals are employed to designate like parts throughout the same.

DESCRIPTION OF THE PREFERRED EMBODIMENTS

While this invention is susceptible of embodiment in many different forms, this specification and the accompanying drawings disclose only one specific form as an example of the invention. The invention is not intended to be limited to the embodiments so described, and the scope of the invention will be pointed out in the appended claims.

For ease of description, the dispensing components are described herein in various positions, and terms such as upper, lower, horizontal, etc., are used with reference to these positions. It will be understood, however, that the components may be manufactured, stored, and used in orientations other than the ones described.

Figure 1:
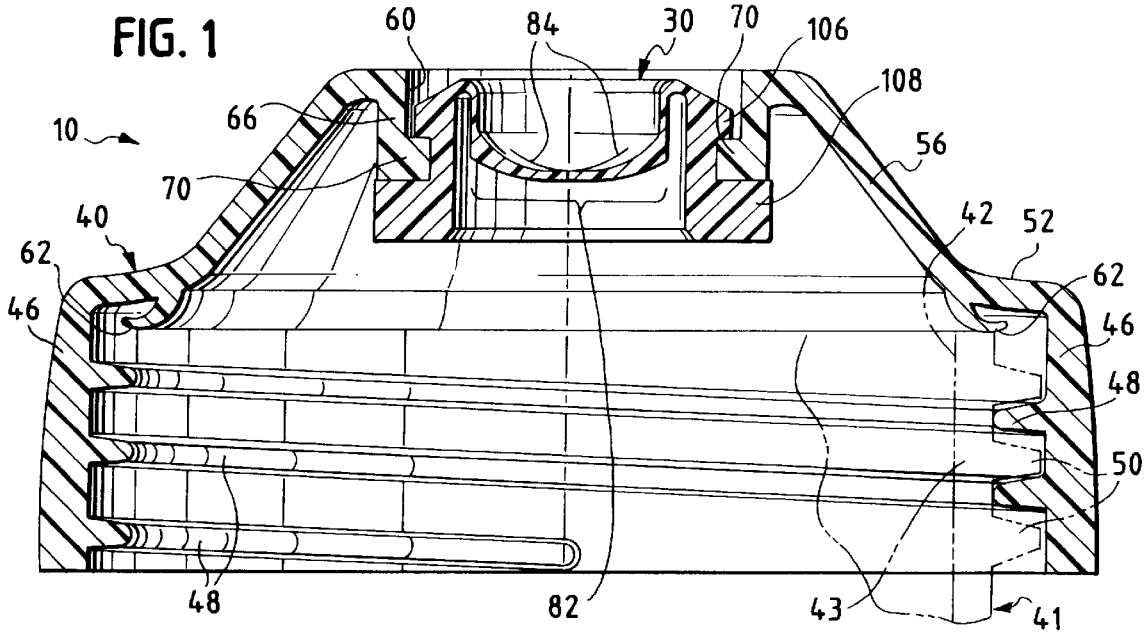
FIG. 1 is an enlarged, cross-sectional view of a dispensing system of the present invention in the form of a valve for use as part of a dispensing closure shown threadingly mounted to the neck of a container (shown in phantom with dashed lines)

A presently preferred embodiment of a dispensing system of the present invention is illustrated in FIG. 1. The dispensing system is provided in the form of a single, unitary valve 30 adapted to be mounted in the discharge opening of a dispensing end structure, such as the discharge end of a container, or as illustrated, in a closure body 40 so as to form a closure 10 which is adapted to be mounted on a container 41 (FIG. 1).

The container 41 has a conventional mouth or opening 42 defined by a neck 43 or other suitable structure. The neck 43 typically has (but need not have) a circular cross-sectional configuration, and the body of the container may have another cross-sectional configuration, such as an oval cross-sectional shape, for example.

The container 41 may typically be a squeezable container having a flexible wall or walls which can be grasped by the user and compressed to increase the internal pressure within the container so as to squeeze the product out of the container through the closure when opened. The container wall typically has sufficient, inherent resiliency so that when the squeezing forces are removed, the container wall returns to its normal, unstressed shape. Such a structure is preferred in many applications, but may not be necessary or preferred in other applications.

The closure body 40 could optionally include a lid (not illustrated) which may be hingedly attached or may be a completely separate, removable component.

The closure body 40 includes an annular skirt or wall 46 which may have suitable connecting means (e.g., a conventional thread 48 (FIG. 1) or a conventional snap-fit bead (not illustrated)) for engaging a suitable container cooperating means, such as a thread 50 on the container neck 43 (or bead, not shown) to secure the closure body 40 to the container 41. The closure body 40 and container 41 could also be fixed together by induction melting, ultrasonic melting, gluing, or the like.

The closure body 40 could alternatively be molded as a unitary part of the container neck 41 to define a dispensing end structure directly on the container 41. In such a design, the container and closure body would be molded as a single, unitary, dispensing end structure, and that would eliminate the need for threaded connection features, or other connection features, on the container. The unitary container/closure body structure would have to be initially molded with an "open" bottom to accommodate subsequent insertion of the valve 30 through the container open bottom and into engagement with the unitary closure body at the dispensing end of the container. The container could then be inverted and filled through the open bottom, after which the open bottom could be closed with a suitable operation (e.g., installing a bottom closure component or deforming the container bottom into a permanently closed configuration).

Near the top of the annular wall 46, the closure body 40 has a deck comprising a first, most outwardly, annular shoulder 52. A spout 56 projects from the shoulder 52. The spout 56 terminates in an outer discharge opening 60 over the container neck opening 42.

Preferably, an annular, flexible "crab's claw" shape seal 62 projects from the bottom of the deck shoulder 52 and is received against the upper edge of the container neck 43 adjacent the container neck opening 42 so as to provide a leak-tight seal between the closure body 40 and the container neck 43. Of course, other types of closure base/container seals may be employed. Also, if air-tightness is not required, no closure base/container seal 62 need be employed.

The container 41 and closure body 40 may be normally stored in the upright orientation wherein the closure body 40 is at the top of the container 41. The container 41 and closure body 40 may also be stored in an inverted position. When the package is stored in the inverted position, the closure body 40 functions as a support base, and the valve 30 holds the product within the container 41 unless the container 41 is squeezed.

The closure body 40 includes an annular wall 66 defining the discharge opening 60. At the bottom of the annular wall 66 there is an annular mounting flange 70 which extends radially inwardly from the wall 66.

Figure 2:
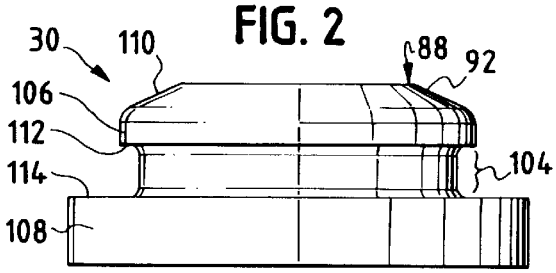
FIG. 2 is a side elevational view of the valve employed in the dispensing closure shown in FIG. 1.
Figure 3:
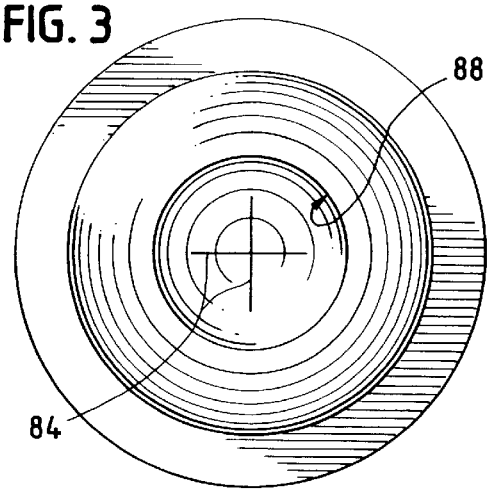
FIG. 3 is a top plan view of the valve shown in FIG. 2.
Figure 4:
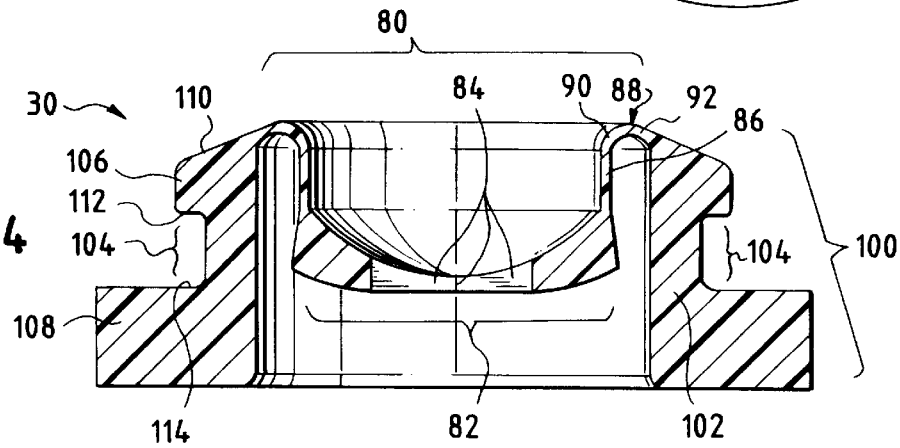
FIG. 4 is a side elevational view of the valve shown in FIG. 2.

The preferred form of the valve 30 is illustrated FIGS. 2–4. The valve 30 employs "head" and "connecting sleeve" portions of a known design employing a flexible, resilient material which can open to dispense product as described in detail hereinafter. The valve 30 may be molded from thermosetting elastomeric materials, such as natural rubber and the like. The valve 30 is preferably from silicone rubber sold by Dow Chemical Company in the United States of America under the trade designation DC-595. However, the valve 30 can also be molded from thermoplastic elastomers based upon materials such as thermoplastic propylene, ethylene, urethane, and styrene, including their halogenated counterparts.

The valve 30, when molded from these materials, is flexible, pliable, elastic, and resilient so that a marginal portion thereof can be temporarily and elastically deformed as it is mounted to, and sealingly engaged with, the spout mounting flange 70.

As shown in FIG. 4, the valve 30 includes a centrally disposed active portion 80. The valve active portion 80, in the preferred embodiment illustrated, has the configuration and operating characteristics of a commercially available valve design substantially as disclosed in the U.S. Pat. No. 5,409,144 with reference to the valve 3*d* disclosed in the U.S. Pat. No. 5,409,144. The operation of such a commercially available valve is described with reference to the valve that is designated by reference number 3*d* in the U.S. Pat. No. 5,409,144. The description of the valve in that patent is incorporated herein by reference to the extent pertinent and to the extent not inconsistent herewith.

As illustrated in FIG. 4 herein, the valve active portion 80 includes a flexible, central, head portion or central wall 82 which has an outwardly concave configuration and which defines at least two, intersecting, dispensing slits 84 extending through the head portion or central wall 82 to define a dispensing orifice. A preferred form of the valve 30 has two, mutually perpendicular, intersecting slits 84 of equal length. The intersecting slits 84 define four, generally sector-shaped, flaps or petals 85 (FIG. 7) in the concave, central wall 82. The flaps 85 open outwardly from the intersection point of the slits 84 in response to increasing pressure of sufficient magnitude in the well-known manner described in the above-discussed U.S. Pat. No. 5,409,144.

The active portion 80 of the valve 30 includes a connector sleeve or skirt 86 (FIG. 4) which extends outwardly from the valve head portion or central wall 82. The outer (upper) end of the connector sleeve 86 includes a thin, annular flange 88 (FIG. 4) which extends peripherally from the skirt 86 to define an upwardly curved portion 90 and a downwardly angled portion 92. The thin flange 88 terminates in an enlarged, much thicker, peripheral marginal portion 100.

The marginal portion 100 is connected with the valve head portion 82 through the connector sleeve 86 and has a generally annular wall 102 defining a generally annular groove 104 (FIG. 4) which is open radially outwardly for receiving the closure mounting flange 70. The annular wall 102 is sufficiently flexible to temporarily deform as the wall 102 is forced against the mounting flange 70 to accommodate seating of the mounting flange 70 in the groove 104. The annular wall 102 is also sufficiently resilient to accommodate the retention of the mounting flange 70 in the groove 104 by adjacent portions of the wall 102.

The generally annular wall 102 includes a generally annular, upper shoulder 106 and a generally annular, lower, retention flange 108. The groove 104 is located below the shoulder 106 and above the retention flange 108.

The upper shoulder 106 defines a generally frustoconical lead-in surface 110 (FIG. 4) facing generally away from the retention flange 108. The upper shoulder 106 also defines a generally annular undercut surface 112 which faces generally toward the retention flange 108 and which defines one side of the groove 104.

The retention flange 108 has a generally flat, annular, upper surface 114 defining one side of the groove 104 and facing toward the undercut surface 112. In the preferred embodiment illustrated in FIG. 4, the retention flange 108 extends radially outwardly beyond the radial extent of the upper shoulder 106.

The valve 30 can be readily assembled with the closure body 40 by forcing the valve 30 into the closure body 40 from the underside or interior side of the closure spout 56. The valve frustoconical lead-in surface 110 engages the bottom, inner peripheral edge of the mounting flange 70. The frustoconical lead-in surface 110 tends to provide a self-centering action for the valve 30 as it is forced upwardly against the flange 70. The valve 30 deforms, by being compressed generally radially inwardly, sufficiently to permit the upper shoulder 106 to move past the mounting flange 70 so that the valve 30 snaps into a tight engagement wherein the mounting flange 70 is received in the groove 104 of the valve 30. Preferably, the height of the groove 104 is very slightly less than the thickness of the mounting flange 70 so as to provide a tight sealing engagement between the valve 30 and the mounting flange 70.

In the preferred embodiment, the groove 104 is defined at a location along the annular wall 102 to locate the sleeve 86 and head portion 82 within the discharge opening 60. That is, the sleeve 86 and head portion 82 are located inwardly of the outer end of the discharge opening 60 so that the valve 30 does not project outwardly beyond the discharge opening 60 when the valve head portion is closed while the valve 30 is mounted to the flange 70 and sealingly disposed with respect to the discharge opening 60.

Preferably, the lower retention flange 108 has a height (e.g., along the vertical axis of the valve 30) which exceeds the height of the groove 104. This provides a relatively substantial anchor function or retention function and better resists forces that might tend to separate the valve 30 from the annular flange 70.

The above-described mounting structure of the dispensing system of the present invention can be readily assembled in a manner which does not require a separate snap-fit clamping member or a separate retainer collar for threaded attachment which could impose undesirable stresses or torque on the valve 30, which stresses and torque could affect the operation of the valve.

The structure of the dispensing system of the present invention simplifies the equipment required for assembly, and the process of assembling the system is less costly. The dispensing system can incorporate a valve 30 of various diameters, slit sizes, and head configurations.

Figure 5:
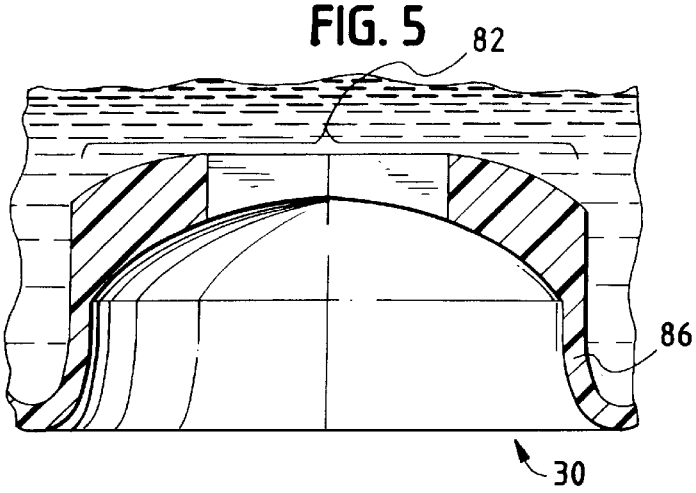
FIG. 5 is an enlarged, fragmentary, cross-sectional view of the valve in the dispensing system on the container shown in FIG. 1 with the assembly in an inverted orientation prior to dispensing product from the container.
Figure 6:
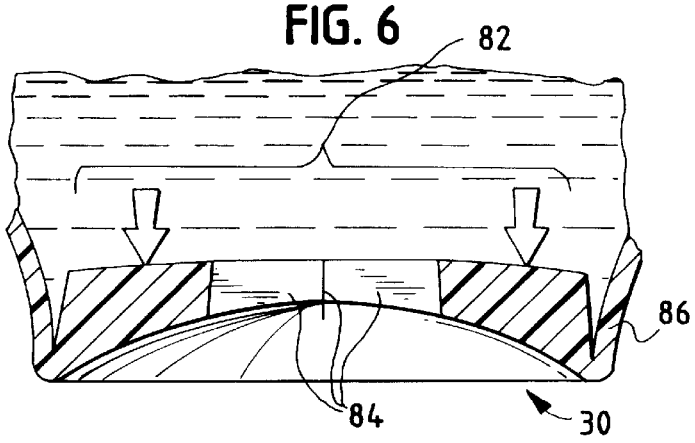
FIG. 6 is a view similar to FIG. 5, but FIG. 6 shows a pressure increase in the container (as when the container is being squeezed) acting on the valve just prior to the valve opening to discharge product from the container.

When the valve 30 is properly mounted within the closure body 40 as illustrated in FIGS. 1 and 5, the head portion 82 of the valve 30 lies recessed within the closure body dispensing opening 60. However, when the container 41 is squeezed to dispense the contents through the valve 30 (as described in detail in the U.S. Pat. No. 5,409,144), then the valve head portion 82 is forced outwardly from its recessed position toward the upper end of the dispensing passage or opening 60 (FIG. 6).

Figure 7:
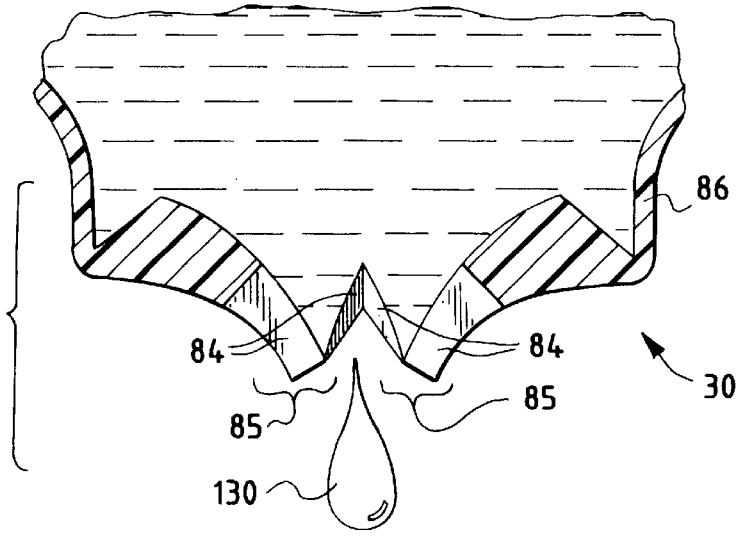
FIG. 7 is a view similar to FIG. 6, but FIG. 7 shows a further orientation of the valve as the container interior is subjected to even greater pressure which causes the valve to move to its fully open condition for dispensing product from the container.

In use, the container 41 is typically inverted and squeezed to increase the pressure within the container above the ambient pressure. This forces the product within the container toward the valve 30 and forces the valve 30 from the recessed or retracted position (illustrated in FIGS. 1 and 5) toward the outwardly extending position. The outward displacement of the valve head portion 82 is accommodated by the relatively thin connector sleeve 86. The sleeve 86 moves from an inwardly projecting, rest position to the pressurized position wherein the sleeve 86 rolls outwardly toward the outside of the closure body 40. However, the valve 30 does not open (i.e., the slits 84 do not open) until the valve head portion 82 has moved substantially all the way to a fully extended position adjacent or beyond the dispensing passage 60. Indeed, as the valve head portion 82 moves outwardly, the valve head portion 82 is subjected to radially inwardly directed compression forces which tend to further resist opening of the slits 84. Further, the valve head portion 82 generally retains its outwardly concave configuration as it moves outwardly and even after it reaches the fully extended position. However, when the internal pressure becomes sufficiently high (so that the difference between the interior pressure and exterior pressure exceeds a predetermined amount), then the slits 84 of the valve 30 begin to open to dispense product (FIG. 7). The product is then expelled or discharged through the open slits 84. For illustrative purposes, FIG. 6 shows a drop of liquid product 130 being discharged.

It will be readily observed from the foregoing detailed description of the invention and from the illustrations thereof that numerous other variations and modifications may be effected without departing from the true spirit and scope of the novel concepts or principles of this invention.

What is claimed is:

1. A dispensing system for communicating with, and dispensing a product from, a discharge opening of a dispensing end structure on a container wherein an annular mounting flange extends radially inwardly adjacent said opening, said system comprising:

a dispensing valve molded from at least one material to define a flexible, resilient structure having a flexible, central head portion, a sleeve extending outwardly from said flexible, central head portion, and a surrounding marginal portion;

said head portion having intersecting slits that define a normally closed dispensing orifice which opens when the pressure in the interior of the container exceeds the pressure on the exterior of the valve by a predetermined amount;

said marginal portion being connected with said sleeve and having a generally annular wall defining a generally annular groove which is open radially outwardly for receiving said mounting flange, said wall being (1) sufficiently flexible to temporarily deform as said wall is forced against said mounting flange to accommodate seating of said mounting flange in said groove, and (2) sufficiently resilient to accommodate the retention of said mounting flange in said groove by adjacent portions of said wall; and said groove being defined at a location along said annular wall to locate said sleeve and head portion within said discharge opening when said valve head portion is closed while said valve is sealingly disposed with respect to said discharge opening.

2. The dispensing system in accordance with claim 1 in which said dispensing end structure is defined by a closure body which is separate from, but releasably attachable to, said container;

said closure body defines said discharge opening;

said annular mounting flange is defined by said closure body at an inner end of said opening; and said valve is adapted to be mounted in said closure body.

3. The dispensing system in accordance with claim 2 in which said closure body is molded from a thermoplastic polymer.

4. The dispensing system in accordance with claim 1 in which said head portion has a generally circular periphery as viewed from the exterior toward said dispensing orifice.

5. The dispensing system in accordance with claim 1 in which said marginal portion generally annular wall includes a generally annular upper shoulder and a generally annular lower retention flange; and said groove is located below said shoulder and above said retention flange.

6. The dispensing system in accordance with claim 5 in which said lower retention flange has a height which exceeds the height of said groove.

7. The dispensing system in accordance with claim 5 in which said upper shoulder defines (1) a generally frusto-conical lead-in surface facing generally away from said retention flange, and (2) a generally annular undercut surface which faces generally toward said retention flange and which defines one side of said groove.

8. The dispensing system in accordance with claim 7 in which said retention flange has a generally flat, annular, upper surface defining one side of said groove and facing toward said undercut surface.

9. The dispensing system in accordance with claim 6 in which said retention flange extends radially outwardly beyond the radial extent of said upper shoulder.

10. The dispensing system in accordance with claim 1 in which said valve is molded from just one material; and said one material is one of a thermoplastic elastomer and a thermosetting polymer.

11. The dispensing system in accordance with claim 1 in which said valve is adapted to be mounted in a closure which is separate from, but releasably attachable to, said container around said opening; and said annular mounting flange is defined by said closure.

* * * * *